US005157448A

United States Patent [19]

Lang

[11] Patent Number: 5,157,448

[45] Date of Patent: Oct. 20, 1992

[54] AUTOMATIC COPIER OR PRINTER PAPER TRAY LOCK

[75] Inventor: Joseph H. Lang, Stamford, Conn.

[73] Assignee: Xerox Corporation, Stamford, Conn.

[21] Appl. No.: 869,588

[22] Filed: Apr. 16, 1992

[51] Int. Cl.[5] ..... G03G 21/00

[52] U.S. Cl. ..... 355/309; 355/200; 355/202; 355/308; 271/157; 271/162

[58] Field of Search ..... 355/200, 202, 308, 309, 355/72, 203, 204, 208; 271/157, 162-164, 9; 400/582, 589, 610.2, 610.3

[56] References Cited

U.S. PATENT DOCUMENTS 4,008,957 2/1977 Summers ..... 355/311
5,096,181 3/1992 Menon et al. ..... 271/157

FOREIGN PATENT DOCUMENTS 0264958 4/1988 European Pat. Off. ..... 355/309

OTHER PUBLICATIONS

Xerox Disclosure Journal, Jack R. Oagley, "Load While Run Copy Handling Module" Mar./Apr. 1984, pp. 113 and 114.

*Primary Examiner*—A. T. Grimley
*Assistant Examiner*—Matthew S. Smith

[57] ABSTRACT

A reproduction machine paper loading drawer interlock system which provides protection from jams by preventing drawer opening during sheet feeding therefrom, yet provides more frequent and/or rapid drawer access for copy paper loading, particularly desirable for loading one drawer while running the machine and feeding sheets from another drawer, by independently operating each paper drawer interlock from the existing wiring and electrical signals for the paper feeder drive for that drawer, without any wiring or unique software requirements from the machine controller, or requiring any machine "cycle out" signals therefrom, or actuation of any manually actuated unlocking switches.

8 Claims, 3 Drawing Sheets

AUTOMATIC COPIER OR PRINTER PAPER TRAY LOCK

Figure 1:
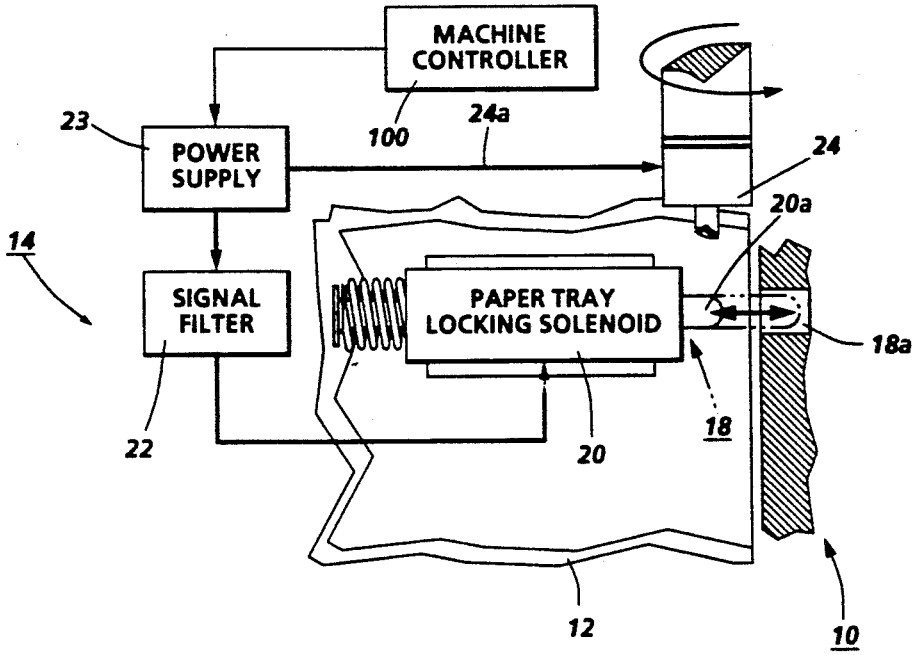

The disclosed system relates to improved operator access interlocks for a copier, printer or other reproducing machine. In particular, there is disclosed an improved automatic locking and unlocking system for copy paper loading drawers or the like, to prevent accidential opening of such a reproducing machine drawer or its cover during sheet feeding from that drawer unit, yet allow improved access for sheet loading into that paper tray drawer when there is not sheet feeding from that drawer unit.

With the disclosed system, a paper tray drawer unit in use may be automatically locked whenever and while it is actually being used for sheet feeding, yet may be otherwise unlocked for loading access, and this may be accomplished very simply and at low cost, utilizing existing electrical signals for the sheet feeding from that drawer unit.

It is well know in the copier apparatus prior art to have copiers with plural paper trays, with associated paper feeders, in the form of paper tray drawer units or modules into which fresh stacks of copy paper can be loaded when the drawer is opened, uncovered and/or slid out from the machine, depending on the drawer unit type. [The paper drawers can even be fully removable and substitutable paper tray cassettes, or high-capacity wheeled modules, in some cases.] Modern copiers or printers desirably provide as many as four or more different paper drawer units, to provide feeding choices of various sizes or types of copy sheets, and/or backup feeding. It is also well known to provide logic electrical interlock switches that stop or shut down the reproduction machine if a door or drawer is opened. It is also known, in particular, to provide electrically controlled locks or latches for these paper tray drawers, so that they cannot be accidentally opened while the machine is running, since that could cause paper jams which may even be operator unclearable if the particular drawer from which paper is being fed by its feeder is opened while it is feeding sheets, especially if the sheets feed transverse the drawer opening direction.

Such known copier and printer electrical paper drawer interlock systems may use the machine control "cycle out" signal to electrically solenoid release, or allow manual release, of such a drawer lock. However, that requires a time delay for the cycle-out of the whole machine [the end of a copying run and the clearance of the entire machine paper path, and/or the stopping of the main drive motor for the photoreceptor and all feeders, etc.] before a paper loading drawer can be opened. A significant additional disadvantage of using a machine control "cycle out" signal to control a paper drawer lock is that extra software and wiring harnesses are required so that the central machine controller can control each paper tray to centrally provide lock and unlock control signals. Reproduction machines with "load while run" capability [see below] do not require "cycle out" to allow paper loading, but typically require manual unlocking with a manually actuated electrical switch for each drawer unit, and wiring and software for electrical copying interruption, or risk jams, as discussed above.

The disclosed system has particular advantages in providing copiers, printers or other reproduction systems with "load while run" capability, although it is not limited thereto. In a "load while run" or "auto tray switching" reproduction machine, fresh copy paper can be reloaded into one paper tray of the machine while the machine is printing from another stack of copy paper in another copy paper input. In such "load while run" operation machines, it is not feasible to use a paper tray drawer interlock controlled by a machine "cycle-out" signal. In "load while run" type products, even those with interlocks, obviously the operator must have access capability to open at least one paper drawer while the machine is still running but feeding from another paper tray, to which the machine has automatically switched over to feed from.

Examples of "load while run" published art include Xerox Corporation U.S. Pat. No. 4,008,957, issued Feb. 22, 1977 to J. Summers; Xerox Corporation U.S. Pat. No. 5,096,181, issued Mar. 17, 1992 to Sukumaran K. Menon, art cited therein, and Xerox Disclosure Journal Vol. 9, No. 2, March/April 1984. pp. 113, 114.

Typical Xerox Corporation "load while run" copying or duplicating machines, such as the "1075", "1090", "1065", and "5090", require a manual drawer unlocking switch button on the tray front to be pressed by the operator, and often a time delay thereafter, in order to unlock and pull out any paper tray.

A very recent modern product, the Xerox Corporation "5100" copier, as understood, has "load while run" capability without manual drawer unlocking switches. It also has a solenoid drawer locking mechanism located at the rear side of each of the paper trays. When "auto tray switching" is selected, a solenoid locks only the main paper tray that is normally in use, (selected for feeding from). However, that main drawer stays locked until that main tray runs out of paper, and a central control signal is provided in response to the sensor detecting an out of paper condition, or what appears to be a machine "cycle-out" completion after the main drive motor stops. In either case, the drawer unlocking signal must be provided centrally from the machine controller with special software. The other trays not in use are unlocked so that they can be opened at any time.

In the recent Xerox Corporation "DocuTech" printer, it is reported that there are three respective paper tray drawers which can be slid out to a fully extended position in order to load paper therein, as is typical. This can only be done after the paper tray elevator therein has dropped from the feed position, (as is also believed to be the case for other products noted above). To prevent the operator from opening the paper tray while it is feeding, a solenoid powered interlock is provided for each tray. When an operator wishes to open the paper tray that is in use, he pushes a "Tray Unlock" button, which may also cause the tray elevator to descend. When the tray is fully down, the locking solenoid is released and a green "Ready To Open" light appears. Whenever a paper tray is not in use, the elevator is normally down, and the tray can be opened without that delay. In the "load while run" function, there is automatic switch-over from the empty tray (i.e., the main tray) to an auxiliary tray, providing that one of the auxiliary trays is loaded with the same paper size and type. (If the same paper stock is not currently loaded in one of these aux trays, the system comes to a stop.) When the main tray is emptied of paper, the tray elevator drops automatically to the load position and the "Ready To Open" light goes on, so that the operator does not have to push the "Tray Unlock" button in that case. While the empty tray is being reloaded, paper stock is fed from the auxiliary tray. Once the main tray is re-loaded and that drawer is closed, its elevator automatically goes back up and its starts to feed to replace the auxiliary tray that is in use, provided there is still a demand for further prints in the controller. (The main tray is always used as the principal tray unless the job program entered in the controller says otherwise.)

A specific feature of the specific embodiments disclosed herein is to provide a reproduction apparatus in which sheets of copy paper may be fed from a plurality of selectable paper drawer units therefor, which paper drawer units are operator openable for reloading more copy paper therein, and closable for feeding the sheets of copy paper therefrom, and which paper drawer units have sheet feeders operatively associated therewith for sequentially feeding the sheets of copy paper therefrom, which sheet feeders are individually actuated by sequential sheet feeding signals to so feed the sheets of copy paper; the improvement in an automatic locking system for protecting against the accidental opening of said paper drawer units during sheet feeding which could cause a paper jam, comprising: independent electrical drawer locks for respective said paper drawer units; said independent electrical drawer locks being automatically independently actuated for said automatic locking by said sequential electrical sheet feeding signals to said sheet feeder associated with said same paper drawer unit; and said independent electrical drawer locks being automatically independently deactivated for unlocking said same paper drawer unit by the absence of said sequential electrical sheet feeding signals.

Further specific features provided by the system disclosed herein, individually or in combination, include those wherein said paper drawer units comprise slide out drawers with at least one integral paper stacking tray and sequential sheet feeder therefor; and/or wherein said electrical drawer locks comprise electrical solenoids powered solely by said electrical sheet feeding signals; and/or wherein further including time delay means for preventing unlocking of said paper drawer unit between immediately sequential sheet feeds; and/or wherein said time delay means also provides a brief time delay after the last sheet feed of a sequence of sheet feeds before said electrical drawer lock is unlocked; wherein said time delay means is an electrical filter electrically connected between said sheet feeding signals and said solenoid and/or wherein said time delay means comprises solenoid movement damping means delaying unlocking of said electrical drawer locks by delaying the operative movement of said solenoid; and/or wherein said electrical drawer locks comprise electrical solenoids powered solely by said electrical sheet feeding signals and wherein said sequential electrical sheet feeding signals are sheet feeder clutch signals for the sheet feeder associated with that paper drawer unit; and/or wherein no manual switch actuation and no other electrical signal from said reproduction apparatus is required to unlock or open a said paper drawer unit.

As discussed above, the term "paper drawer units" as used herein broadly encompasses various types of copier paper supply or input arrangements. Likewise, the term "copy paper" can encompass various similar suitable alternative image substrates, such as plastic transparencies. Likewise, "opening" and "closing" such paper drawer units may encompass partial insertions or separate covers for such units in some cases. All this is well known in the art.

All references cited in this specification, and their references, are incorporated by reference herein where appropriate for appropriate teachings of additional or alternative details, features, and/or technical background. As to specific hardware components of the subject apparatus, it will be appreciated that, as is normally the case, some usable specific hardware components are known per se in other apparatus or applications, and in the above-cited and other art.

Figure 2:
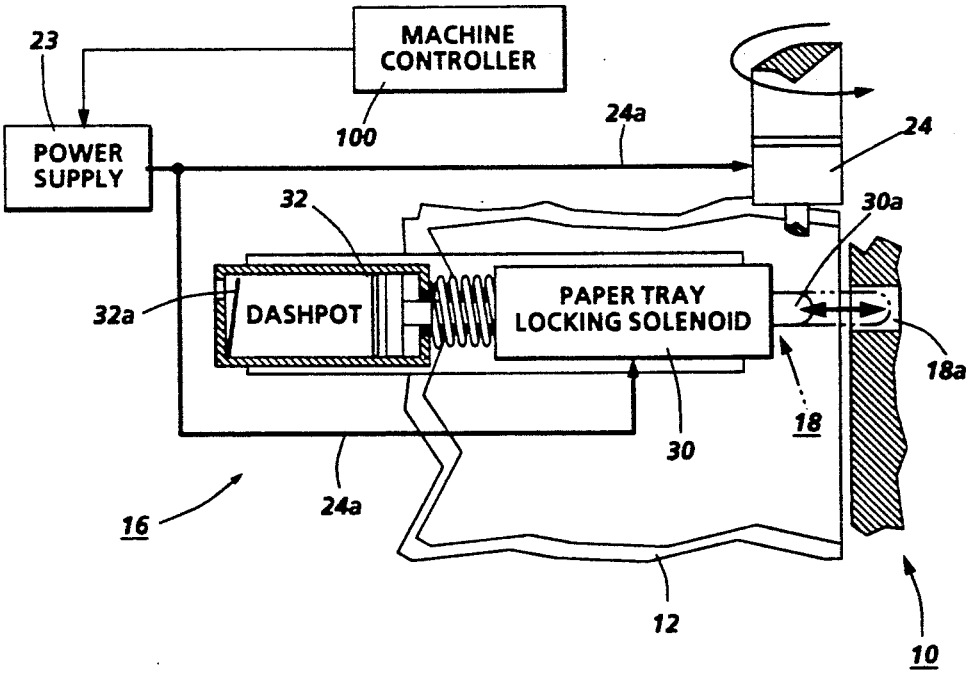
Figure 3A:
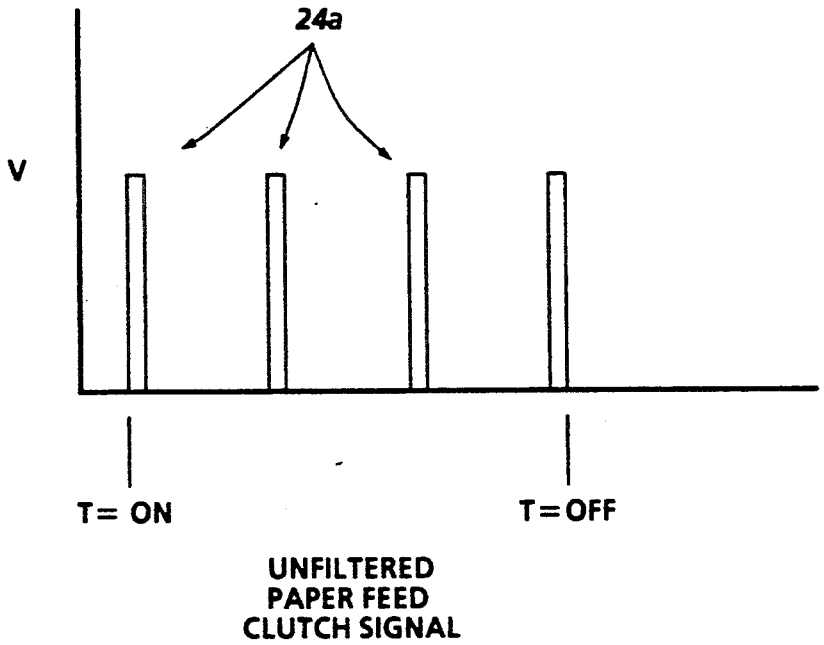
Figure 3B:
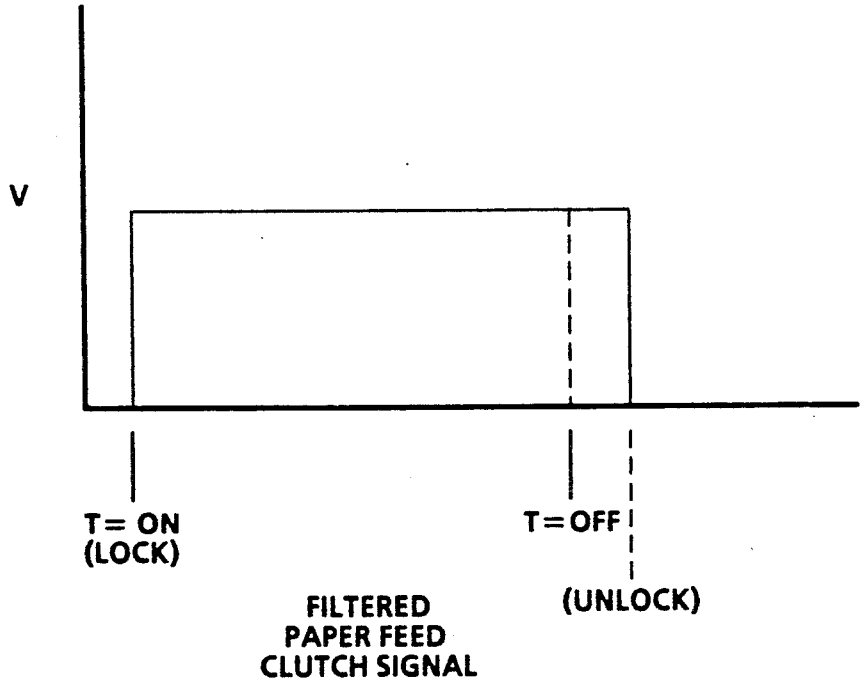
Figure 4:
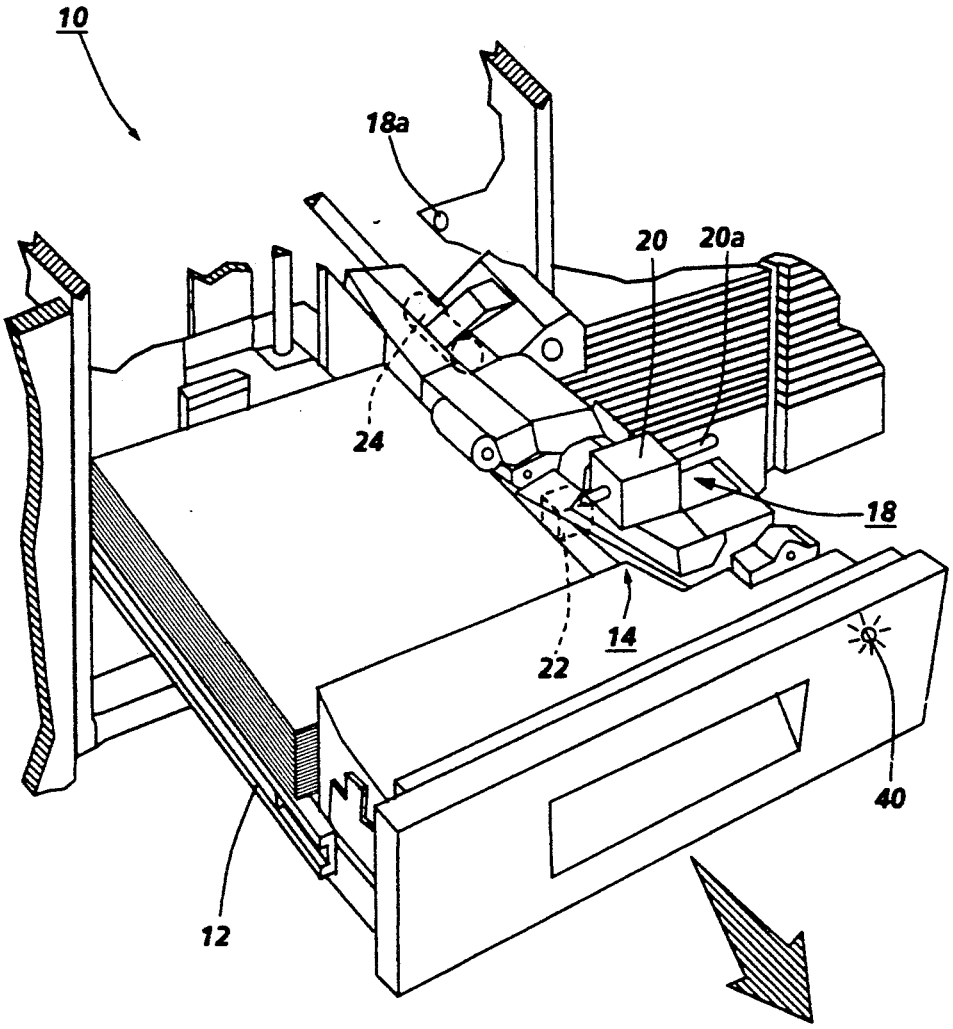

Various of the above-mentioned and further features and advantages will be apparent from the specific apparatus and its operation described in the examples below, as well as the claims. Thus, the present invention will be better understood from this description of these embodiments thereof, including the drawing figures (approximately to scale except as noted) wherein:

FIG. 1 is a schematic top view of one embodiment of the subject paper tray locking system; and FIG. 2 is a schematic view of an alternative embodiment of FIG. 1 without a signal filter and with a damped solenoid;

FIGS. 3*a* and 3*b* show the electrical signals that are respectively the input and an exemplary idealized output of the signal filter of FIG. 1; and FIG. 4 is a partial perspective view of the exemplary embodiment of FIGS. 1 and 3 with the paper drawer open.

Describing now in further detail the exemplary embodiments with reference to the Figures, there is shown only a portion of a reproducing machine 10. The machine 10 is merely by way of one example of almost any copier, printer or the like, comprising at least one paper drawer 12. In FIGS. 1 and 4, one example 14 of the subject drawer 12 interlock system is shown. Another exemplary interlock system 16 is shown in FIG. 2.

Preferably this machine 10 has several other such paper loading and feeding drawers 12 (which need not be shown here) each independently interlocked in the same manner, with similar latches or locks 18. Also, preferably the machine 10 has "load while run" capability, as described above and in the above-cited references.

In contrast to various above-cited references, the reproduction machine 10 paper drawer interlock systems 14 or 16 in the specific embodiments here provide protection from the possibility of jams, yet provides more frequent and/or rapid drawer access for copy paper loading, by independently operating and powering the paper drawer interlock system solely from the existing wiring and electrical signals for the paper feeder drive for that specific drawer, so that the drawer is thereby only locked during its feeding, yet eliminating any additional wiring and software requirements or the need for any signals from the machine controller.

That is, instead of requiring additional central controller 100 signal connection and/or a manually actuated drawer unlocking button and its control signal to unlock a normally locked paper tray (to prevent paper jams by opening a drawer during feeding), here each paper tray 12 is kept solenoid locked only whenever paper feeding signals are being sent to the feeder associated with that tray. Both the FIG. 1 and FIG. 2 lock systems 14 and 16 use an existing electrical signal from the already wired power supply for the paper feeder of that particular tray. This saves on wiring and software as well as not requiring an extra switch for each paper tray, and gives the operator access to pull out any drawer not in actual use without any delay, resistance or manual unlocking switch manipulation. The disclosed paper tray interlock systems 14 or 16 enable solenoid tray lock control of an existing copier or printer without software changes, or redesign of high-cost input/output control boards, and separate power drivers or switches, and the corresponding tooling and schedule impacts.

In the FIG. 1 interlock system 14 embodiment there is shown a drawer 12 lock 18 conventionally actuated by an electrical solenoid 20 powered solely by the output of a signal filter 22. The signal filter 22 is electrically connected only to the electrical input to the paper feeder drive 24 for that drawer 12, which is power supply 23. Specifically, in this example, the filter 22 is provided as its input with the electrical clutch signals 24*a* for the paper feeder drive 24. Like the drawer 12 and its integral paper tray, the paper feeder drive 24 here may be any of various conventional sheet separator/feeders well know in copiers and printers to sequentially feed sheets from a stack of sheets and need not be described here. Utilization of an existing pulsed signal, such as the stream of immediately sequential sheet feeding pulses to a conventional paper feeder clutch, signal 24*a*, with any suitable filtering, is the approach in system 14. That is, in the FIG. 1 lock system example 14, the paper feeder clutch signals or the like are filtered [or otherwise integrated or converted by a time delay gate or the like] to insure that the drawer locking solenoid is not intermittently operated between individual sheet feedings or otherwise too frequently actuated.

The filter 22 filters the sequential sheet feeding pulses 24*a* as approximately shown in FIG. 3*a* (its input) versus FIG. 3*b* (its idealized output). This not only prevents noise or chatter from the solenoid 20, it prevents the unlocking of the lock 18 by solenoid 20 in between the sequential sheet feeding signals. That is, the filter 22 keeps solenoid 20 powered with a sufficient holding current (which, of course, may be less than the required pull-in current) intermediate of the sequential applied feeder clutch 24 signals 24*a* shown in FIG. 3*a*. Also, as shown in FIG. 3*b*, the filter 22 provides an additional time delay (or signal integration roll off) after the end of the last sheet feeding signal sufficient to allow that last feed sheet to clear the tray area of drawer 12 before current to the solenoid 20 drops below the holding current level needed to keep the solenoid 20 return spring from unlatching lock 18. The filter 22 could be any suitable, conventional or commercially available device or circuit, such as a time delay (latching) relay, or a known time-delay circuit, such as a monostable multi-vibrator or Schmidt trigger circuit, or an op-amp integrator or other active filter.

In the FIG. 2 embodiment interlock system 16, there is no signal filter and the electrical solenoid 30 which is operating lock 18 here is self-damped. The solenoid 30 may be connected directly to the unfiltered applied pulse signals 24*a* of the same paper feeder drive 24 clutch. These power signals (e.g., 24 volts D.C. pulses) are already being provided by the existing power supply 23, (on feeding command by central controller 100) and the solenoid 30 is directly connected in parallel with clutch 24 to the same power supply 23 output in this embodiment. The same drawer 12 and its lock 18 example is also shown here. The drawer locking solenoid 30 in this case will receive a stream of pulsed signals as paper is being fed from tray 12, but as long as the reaction time of the solenoid 30 is slow enough to keep the drawer/tray 12 locked until the paper path from the tray is clear after the last sheet feed, it will be effective. (However, this pulsing of the solenoid may produce an annoying noise, depending upon the machine paper feeding speed and the duration between the pulses.) That is, unfiltered pulsed feeder signals can be applied directly to the lock solenoid if the pulse "off" times and solenoid response times are respectively appropriate. (The same difference from prior art machines in how the lock solenoid operator control signal is derived still applies.) This is the cheapest way to implement this concept.

However, as shown in the FIG. 2 embodiment, the solenoid 30 can also be externally damped, such as by a dashpot 32, rather than depend on internal damping. In the FIG. 2 approach, the response time to lock the paper tray is affected by the dashpot 32 characteristics. If the dashpot is too slow, (too high a resistance) the paper tray 12 might be opened before the lock 18 is actually engaged even though the sheet feeder power is applied in time to the solenoid 30. This can be overcome, for example, by the inclusion of a simple 1-way pneumatic flapper or other valve 32*a* in the dashpot 32, as shown. This valve 32*a* allows the solenoid to move into the locked position quickly, with virtually no dashpot 32 resistance, but allows the dashpot 32 to have high resistance in the other direction of movement, to slow the solenoid 30 plunger attempted retraction whenever the stream of pulsed signals 24*a* end when the tray stops feeding paper or between pulses. The dashpot 32 thus slows the paper tray 12 unlocking, but not locking response time. The unlocking time delay is not expected to be a problem since it is brief and the last paper feed is always completed several seconds before the machine cycle-out, the point in time after which the customer most commonly would try to open the paper drawer.

The drawer lock 18 may be a simple, direct 'deadbolt' style lock with its bolt-operating solenoid 20 or 30 mounted in the tray 12, as shown. [Or the locks may be on the machine 10 frame instead.] There are many different locking mechanism variations possible. Here, when the solenoid 20 or 30 is actuated, by power from the feeder 24 actuation, the solenoid plunger directly moves an integral bolt or lever 20*a* or 30*a* extension. This movement is transverse the tray 12 pull out movement direction. The bolt 20*a* or 30*a* here engages a mating retaining aperture 18*a* in the machine frame [or the paper tray, if the lock is mounted in the machine frame]. This positively prevents that particular paper tray 12 from opening, as long as power is applied to the solenoid. A conventional return spring automatically retracts the bolt for unlocking when power is removed. Thus, here this latch/lock 18 positively prevents the drawer 12 from opening only as long as power is being applied to the paper feeder clutch, and for a brief time period thereafter [or as long as power is being applied to a paper feeder drive motor, if such a signal is provided instead of a clutch signal].

Another alternative embodiment is to similarly solenoid lock machine covers over the paper trays, prohibiting access to the paper trays. The tray is similarly being locked against operator access only while the tray is actually feeding, allowing the customer to open the tray immediately after the last sheet is fed.

As noted above, the present system can provide parts and wiring reductions. In, for example, a copier or printer with four different paper loading drawers, the present system can provide "load while run" capability and jam protection with a cost savings on as much as four control boards, four transistor driver power switches, four wiring harnesses, and four tray lock switches, one each for each paper drawer, and considerable software code.

It will be appreciated that another interlock (not shown) may be conventionally provided so that power will not be applied to the tray 12 paper feeder clutch (or motor) if this conventional drawer interlock switch indicates that the drawer is open or being opened. However, if the paper feeder drive disengages mechanically as soon as the drawer 12 starts to open, this additional interlock may not be required.

It has been suggested that if one particular drawer is used or shared as a duplex tray drawer (in which sheets copied on one side are temporarily stored before their second side imaging), an additional, parallel connected, lock signal from the copier controller can be provided for that (one) drawer when duplexing is selected. Alternatively, the present system need not be used for such drawers, and a conventional, e.g., cycle-out signal unlatching system can be used instead for such duplex drawers.

If desired, the same paper feed pulse stream used to operate the drawer latch may also be connected to an LED lock light 40 on the drawer 12 front (see FIG. 4) to signal the operator that that drawer is "in use" by a pulsing light on that drawer. Tray "locked" lights are well known per se but here there can be a direct connection with no software control or additional time delay requirements because locking coincides with actual feeding.

Cross-reference is made to a Fuji Xerox Corporation Japanese application File No.. FX/28192, reportedly filed Jan. 28, 1991 in Japan, only, unbeknownst to this inventor or assignee. As this Japanese application is not yet published, and was subsequent to this inventor's conception, it is assumed that it is not a prior art reference. Subsequent information is that it relates to covering the paper tray handle opening. That is, it discloses another device for a sheet feed tray for restraining the operator from opening the sheet feed tray while it is in use. There, a finger insertion is closed through a lever member associated by a solenoid in the drawer, which solenoid is actuated by filtering a paper feeder clutch signal and applying it to the solenoid. That is, this filtered signal operates a solenoid to pivot a cover plate over the operator finger access to the drawer handle or pull recess. [The paper drawer is apparently not actually ever positively locked in this FX case variant, but if the drawer has no other operator graspable recess or projection, the drawer is unlikely to be accidentally opened during paper feeding from it.]

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a reproduction apparatus in which sheets of copy paper may be fed from a plurality of selectable paper drawer units therefor, which paper drawer units are operator openable for reloading more copy paper therein, and closable for feeding the sheets of copy paper therefrom, and which paper drawer units have sheet feeders operatively associated therewith for sequentially feeding the sheets of copy paper therefrom, which sheet feeders are individually actuated by sequential sheet feeding signals to so feed the sheets of copy paper;

the improvement in an automatic locking system for protecting against the accidental opening of said paper drawer units during sheet feeding which could cause a paper jam, comprising:

independent electrical drawer locks for respective said paper drawer units;

said independent electrical drawer locks being automatically independently actuated for said automatic locking by said sequential electrical sheet feeding signals to said sheet feeder associated with said same paper drawer unit; and said independent electrical drawer locks being automatically independently deactivated for unlocking said same paper drawer unit by the absence of said sequential electrical sheet feeding signals, further including time delay means for preventing unlocking of said paper drawer unit between immediately sequential sheet feeds.

2. The reproduction apparatus of claim 1, wherein said paper drawer units comprise slide out drawers with at least one integral paper stacking tray and sequential sheet feeder therefor.

3. The reproduction apparatus of claim 1, wherein said electrical drawer locks comprise electrical solenoids powered solely by said electrical sheet feeding signals.

4. The reproduction apparatus of claim 1, wherein said time delay means also provides a brief time delay after the last sheet feed of a sequence of sheet feeds before said electrical drawer lock is unlocked.

5. The reproduction apparatus of claim 1, wherein said electrical drawer locks comprise solenoids, and wherein said time delay means is an electrical filter electrically connected between said sheet feeding signals and said solenoid.

6. The reproduction apparatus of claim 1, wherein said electrical drawer locks comprise solenoids, and wherein said time delay means comprises solenoid movement damping means delaying unlocking of said electrical drawer locks by delaying the operative movement of said solenoid.

7. The reproduction apparatus of claim 1, wherein said electrical drawer locks comprise electrical solenoids powered solely by said electrical sheet feeding signals and wherein said sequential electrical sheet feeding signals are sheet feeder clutch signals for the sheet feeder associated with that paper drawer unit.

8. The reproduction apparatus of claim 1, wherein no manual switch actuation and no other electrical signal from said reproduction apparatus is required to unlock or open a said paper drawer unit.

* * * * *